United States Patent [19]

Maier

[11] Patent Number: 4,478,385

[45] Date of Patent: Oct. 23, 1984

[54] CLIMBING FORMS

[76] Inventor: Josef Maier, Schwimmbadstr. 3, D-7611 Steinach, Fed. Rep. of Germany

[21] Appl. No.: 536,822

[22] Filed: Sep. 28, 1983

Related U.S. Application Data

[63] Continuation of Ser. No. 373,532, Apr. 30, 1982, abandoned.

[30] Foreign Application Priority Data

May 2, 1981 [DE] Fed. Rep. of Germany ..... 3117409

[51] Int. Cl.[3] ..... E04B 11/22

[52] U.S. Cl. ..... 249/20; 425/65

[58] Field of Search ..... 425/65

[56] References Cited

U.S. PATENT DOCUMENTS

| | | | |
|---|---|---|---|
| 2,885,762 | 5/1959 | Johansson | 249/20 |
| 3,472,477 | 10/1969 | Juhl | 249/20 |
| 4,040,774 | 8/1977 | Scheller | 249/20 |
| 4,081,227 | 3/1978 | Bohmer et al. | 249/20 |
| 4,253,810 | 3/1981 | Bezhanov et al. | 249/20 |
| 4,290,576 | 9/1981 | Schwörer | 249/22 |

FOREIGN PATENT DOCUMENTS

| | | | |
|---|---|---|---|
| 18014 | 10/1980 | European Pat. Off. . | |
| 2217584 | 12/1972 | Fed. Rep. of Germany . | |
| 2653462 | 6/1978 | Fed. Rep. of Germany . | |
| 2814141 | 10/1978 | Fed. Rep. of Germany . | |
| 7505220 | 10/1976 | France | 249/20 |
| 2307940 | 12/1976 | France . | |

*Primary Examiner*—Jay H. Woo
*Assistant Examiner*—James C. Housel
*Attorney, Agent, or Firm*—Peter K. Kontler

[57] ABSTRACT

Climbing forms for stepwise erection of concrete walls have a platform which is supported by a frame having elongated carriers extending at right angles to the outer side of the wall to be erected and being removably suspended on anchors which are embedded in the wall. The platform supports a pair of parallel guide rails for a form member which carries the boarding of the climbing forms. The rails guide the carriages of the form member so that the boarding can be moved between an advanced position in which it is adjacent to the cavity into which concrete is to be poured and a retracted position in which the wall and the boarding define a passageway which is accessible to workmen on the platform so that the workmen can clean and/or otherwise treat that side of the boarding which faces the wall. The guide rails are mounted in such a way that the platform need not be provided with uncovered slots, gaps, cutouts or other types of openings which would endanger the occupants of the platform or would permit objects to drop from the platform and thus endanger the persons or equipment below the climbing forms.

14 Claims, 7 Drawing Figures

10
15
15
7
4
11
9
5
4
14
2
3
10
10'
4
11
9
4
15
15
7
8
15
1

CLIMBING FORMS

This application is a continuation of application Ser. No. 373,532, filed Apr. 30, 1982, now abandoned.

BACKGROUND OF THE INVENTION

The present invention relates to forms for the pouring of concrete or the like, and more particularly to improvements in so-called climbing forms. Climbing forms are utilized for the pouring of arcuate or flat concrete walls, and they are designed in such a way that a crane or an analogous lifting machine can raise the assembled forms when the pouring of a particular section of a wall is completed so that the raised forms are in a proper position for the pouring or otherwise forming of the next-higher section or sections of the wall. By way of example, such climbing forms can be used for the pouring of a cylindrical wall which forms part of a large outdoor tank or an analogous vessel. The invention also relates to self-climbing forms which are designed for movement to different levels without assistance from a crane or the like.

It is already known to assemble climbing forms in such a way that the boarding which is normally adjacent to the cavity into which concrete is poured can be moved away from the freshly formed wall in order to provide room for workmen who are in charge of cleaning the boarding preparatory to movement of climbing forms to a different level. Such forms further comprise a working platform which is mounted on a frame. The frame is separably attached to the wall so that it can be detached when the material of the wall has set and preparatory to movement of the climbing forms to a different level or to the ground. As a rule, the frame includes several elongated carriers extending at right angles to the outer side of the wall and connectable to anchors which are embedded in the material of the wall. Reference may be had to German Pat. No. 22 17 584 and to German Offenlegungsschrift No. 24 45 383. The boarding of the climbing forms which are disclosed in these publications is movable along the carriers of the frame for the working platform so as to provide space between the boarding and the freshly poured and hardened section of the wall. The space is needed in order to enable the workmen to gain access to the inner side of the boarding, namely, to that side which was in contact with the material of the wall. In other words, the carriers of the frame for the working platform perform several functions, namely, they reinforce or stiffen the frame for the platform and they guide the boarding during movement toward and away from the adjacent side of the wall. A drawback of such climbing forms is that the platform must be provided with openings for the understructure or carriage of the boarding, i.e., the openings are needed in order to enable the carriage to engage and to move along the carriers which are disposed at a level below the panels of the platform. The openings in the platform represent a danger to the workmen and they also permit substances or objects (such as cleaning media, heavy tools, bricks and pieces of lumber) to flow or fall to the ground with attendant danger to the persons or equipment therebelow. Furthermore, the workmen on the platform must be on guard, at all times, for the presence of such openings; this interferes with their work.

Another drawback of the just discussed conventional climbing forms is that they are invariably restricted to use in connection with the erection of straight or flat walls. This is due to the fact that the aforediscussed carriers extend at right angles to the outer sides of the walls. If the outer side of a wall is convex, the radially outwardly extending carriers cannot properly guide a boarding or the carriage for a boarding which must be moved toward and away from the convex side of the wall. The reason for placing the carriers at right angles to the wall, i.e., radially of an arcuate wall whose outer side is convex, is that the carriers are attached to anchors which, in order to ensure that they be properly embedded in the material of the wall, must extend at right angles to the outer side of the wall.

OBJECTS AND SUMMARY OF THE INVENTION

An object of the invention is to provide novel and improved climbing forms wherein the boarding can be moved toward and away from a wall irrespective of the configuration of the outer side of the wall and without necessitating the provision of one or more openings in the platform or platforms of the forms.

Another object of the invention is to provide climbing forms wherein the boarding is movable between advanced and retracted positions in a novel and improved way.

A further object of the invention is to provide climbing forms for use in connection with the erection of arcuate walls and to construct and assemble the forms in such a way that the boarding can be cleaned and/or otherwise treated while the forms are attached to the wall, i.e., without necessitating lowering of the forms to the ground.

An additional object of the invention is to provide the climbing forms with novel and improved guide means for the boarding.

Another object of the invention is to provide the climbing forms with novel and improved means for limiting the extent of movement of the boarding relative to the platform.

An additional object of the invention is to provide climbing forms which are designed to reduce the likelihood of danger to the occupants and/or to the persons and equipment therebelow.

Another object of the invention is to provide climbing forms whose boarding can be moved between advanced and retracted positions while the forms are suspended on an arcuate wall and in spite of the fact that the forms may be provided with divergent carriers for the platform as well as in spite of the fact that the platform need not be provided with openings which would represent a danger to the occupants of the forms and/or would permit fluids or objects to flow or fall from the platform.

An additional object of the invention is to provide climbing forms which are more versatile but not more expensive or more complex than heretofore known climbing forms.

The invention is embodied in climbing forms for stepwise erection of masonry structures such as arcuate or flat concrete walls. The climbing forms comprise at least one substantially horizontal platform, a frame which supports the platform and can be separably supported by the structure which is being erected, a boarding which is disposed at a level above the platform, a form member or analogous means for moving the boarding between an advanced position in which the boarding is adjacent to the structure which is being erected (the boarding then flanks one side of the adjacent portion of the cavity into which concrete is being poured to form a section of a wall) and a retracted position in which the boarding and the structure define a passageway which is accessible to the occupants of the platform, and guide means for the moving means. Such guide means is provided on the platform and the moving means is movable along the guide means to move the boarding between the advanced and retracted positions.

The guide means can comprise at least one elongated rail for the moving means, preferably a plurality of at least substantially parallel horizontal or nearly horizontal rails. The frame for the platform can comprise at least two spaced-apart elongated carriers in the form of metallic beams or the like, and the rail or rails are disposed, at least in part, between such carriers. For example, if the structure is an arcuate wall having a convex outer side and the carriers extend radially outwardly of the exposed side of the wall so that they diverge in a direction away from the exposed side of the wall and make a predetermined angle (e.g., an acute angle), the rails of the guide means can be disposed in planes which are parallel to a plane having such angle.

The moving means can comprise a carriage which is reciprocable along the rail or rails of the guide means. Such carriage can have at least one roller, wheel or an analogous rotary element which is arranged to roll along a rail of the guide means. The rail which is engaged by such rotary element can include an elongated portion (e.g., a horizontal flange) having an underside which is adjacent to the rotary element so that the carriage cannot be lifted off such rail. The rail which cooperates with the rotary element can constitute a U-rail having a vertical web and a horizontal flange at the upper end of the web. The rotary element is then adjacent to the underside of such flange, i.e., it extends into the groove between the web and the two flanges of the U-rail. Alternatively, the rail which cooperates with the rotary element can constitute a T-rail or an I-rail with an upright web and a horizontal flange at the upper end of the web so that the rotary element can travel along the underside of such flange. The rail or rails of the guide means can be mounted in such a way that their upper sides are substantially flush with, at a level below or at a level above the upper side of the platform. The arrangement may be such that the platform includes a floor and a set of beams which rest on the frame and support the floor. The rail or rails of the guide means can be mounted on the beams and the floor can flank such rail or rails, e.g., the lower flanges of I-rails. The boards of which the floor is assembled can extend into immediate proximity of and can be disposed at both sides of each rail to prevent the formation of clearances or gaps which would endanger the occupants of the platform or would permit objects to fall off the platform. Alternatively, the rail or rails of the guide means can be mounted directly on the floor of the platform so that the floor need not be formed with any slots which are evidently necessary when the rail or rails are supported directly by the beams for the floor.

Still further, the climbing forms can comprise means for releasably locking the moving means in at least one of the two positions of the boarding. Such locking means can comprise at least one bolt, e.g., a bolt which can be inserted through a hole in a rail forming part of the guide means.

The novel features which are considered as characteristic of the invention are set forth in particular in the appended claims. The improved climbing forms themselves, however, both as to their construction and their mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
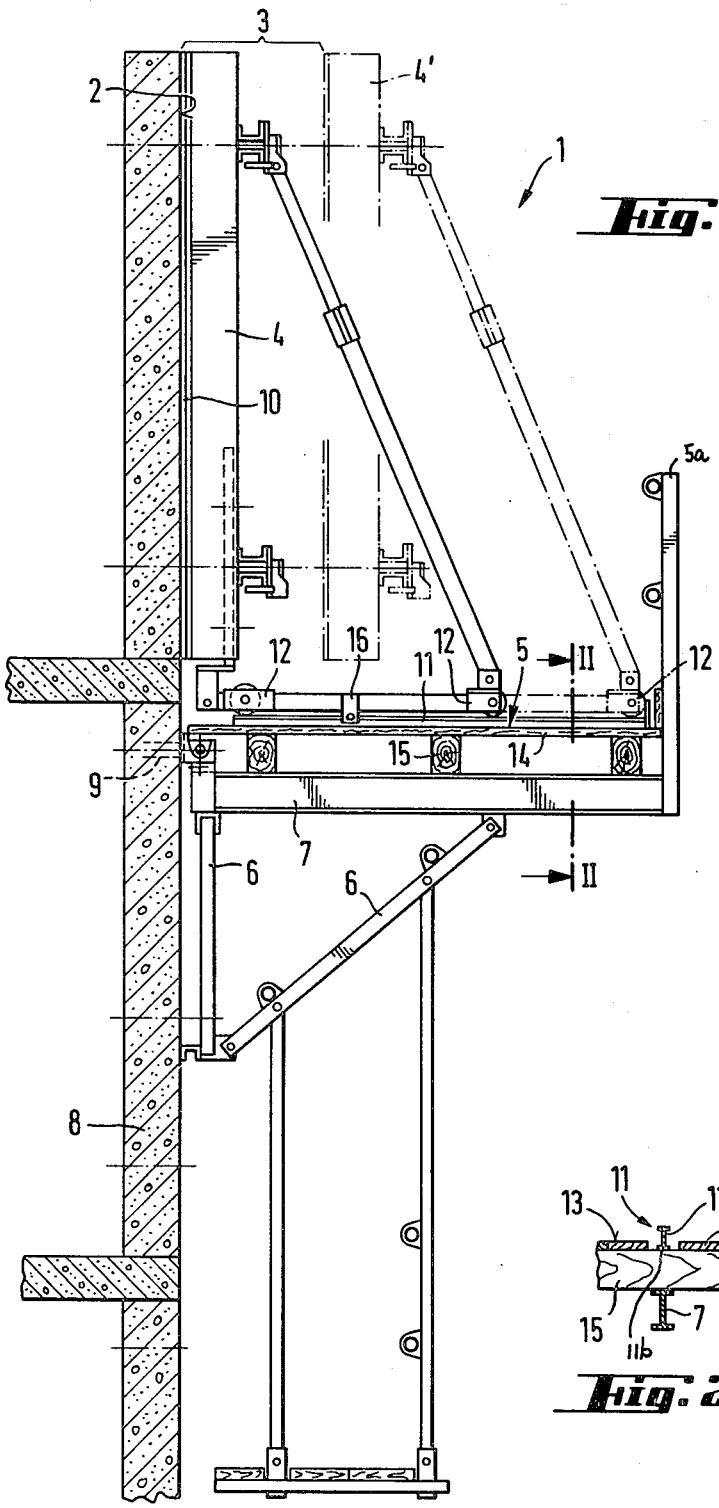
FIG. 1 is a schematic side elevational view of climbing forms embodying one form of the invention, the advanced positions of the boarding and its form member being indicated by solid lines and the retracted positions of such parts being indicated by broken lines.
Figure 3:
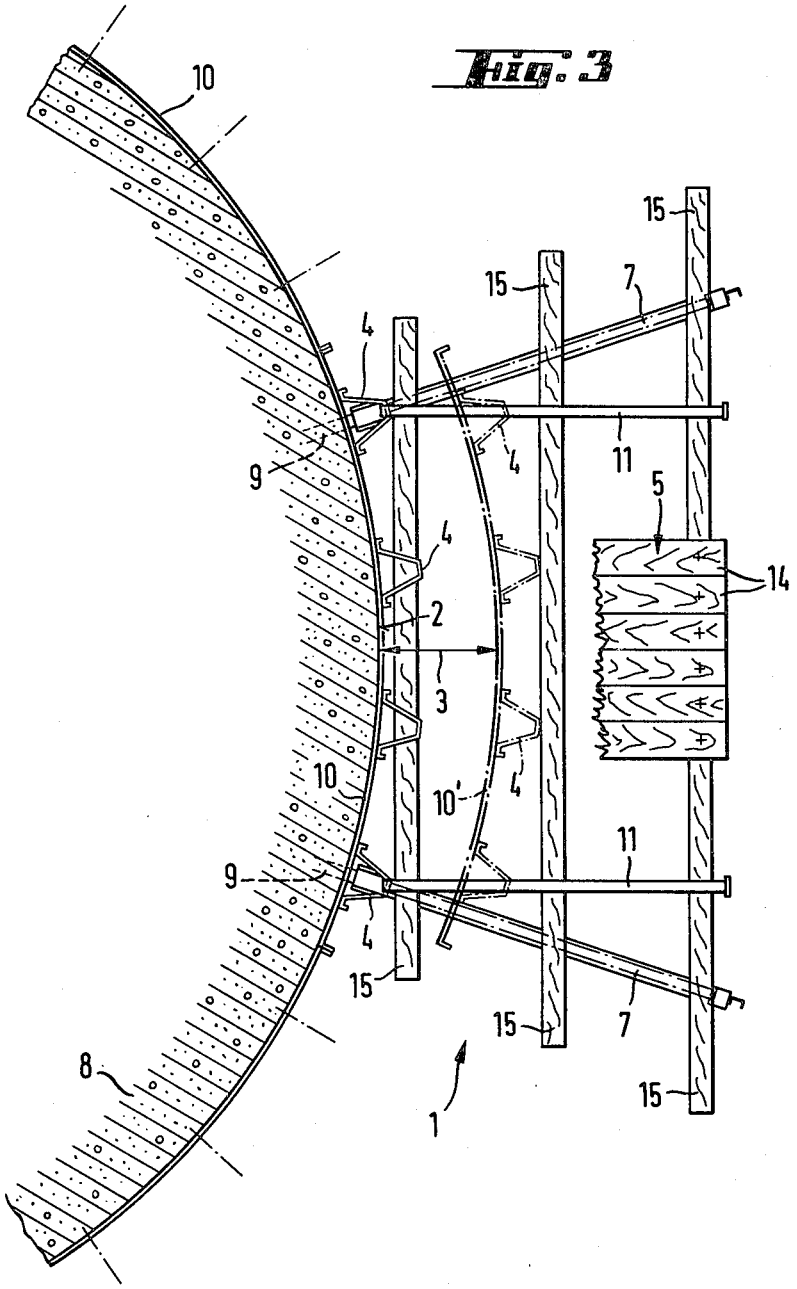
FIG. 3 is a plan view of the climbing forms of the type used for erection of walls having convex external surfaces.

FIGS. 1 and 3 show climbing forms 1 mounted at the convex side 2 of a concrete wall 8 and supported thereon by anchors 9 which are embedded in the material of the wall. Such anchors are inserted into cavities of the forms at progressively higher levels, and the forms 1 are lifted by a crane from level to level as the poured material sets.

The forms 1 comprise a boarding 10 which determines the convex outline of the external surface 2 of the concrete wall 8 and is inwardly adjacent to a composite form member 4 which is movable (with the boarding) toward and away from the outer side of the wall 8, namely, between the solid-line advanced position and the broken-line retracted position 4' of FIG. 1. When moved to the retracted position 10', the boarding 10 defines with the wall 8 an arcuate passageway 3 wherein the workers can move along the inner side of the boarding by standing on a working platform 5 which has a railing 5*a* and is disposed at a level below the lower part of the boarding. The platform 5 is supported by a climbing frame 6 which includes elongated substantially horizontal carriers 7 in the form of metallic I-beams (see FIG. 2). The carriers 7 extend substantially at right angles to the adjacent portions of the boarding 10, i.e., radially outwardly from the concrete wall 8. If the wall 8 is not arcuate but flat, the carriers 7 extend at right angles to the outer side of the flat wall. The inner end portions of the carriers 7 can be suspended on or otherwise removably secured to the aforementioned anchors 9 in the hardened portion of the concrete wall 8. When the workmen complete the pouring of the next-higher section of the wall 8 and when such freshly poured section sets, the entire forms 1 are lifted by a crane and the inner end portions of the carriers 7 are then attached to the next set of anchors 9 at a level above the anchors which are shown in FIG. 1 at the general level of the working platform 5. The anchors 9 can extend through the entire concrete wall 8 and their inner end portions can carry nuts or other types of retaining elements which prevent extraction of such anchors from the wall 8 to thereby enhance the safety of workmen on the platform 5.

Upon completion of a concrete pouring operation, the component parts of the boarding 10 are normally cleaned and coated with a suitable separating or stripping agent. Heretofore, such cleaning and stripping operations were carried out subsequent to detachment of the entire conventional climbing forms from the wall by resorting to a crane and while the forms were resting on the ground. In accordance with a feature of the present invention, the boarding 10 can be cleaned while the forms 1 remain attached to the wall 8. All that is necessary is to shift the composite form member 4 to its retracted position 4' so as to provide the aforementioned passageway 3 between the convex surface 2 of the freshly poured and hardened section of the concrete wall 8 and the internal (concave) surface of the boarding 10. The latter is attached to and thus shares the movements of the form member 4 between its advanced and retracted positions. The workmen standing on the platform 5 are then in a position to gain access to the concave side of the boarding 10 and to clean such concave side while the entire climbing forms 1 continue to be supported by the wall 8. In other words, a crane is needed only when the workmen desire to lower the forms 1 upon completion of the last stage of a concrete pouring operation or when the forms 1 must be lifted to the next-higher level preparatory to pouring of a fresh section of the wall. It will be readily appreciated that the features of the present invention (such as the boarding 10 which is movable relative to the working platform 5 while the forms remain attached to the wall) can be incorporated with equal or similar advantage in other types of forms, such as in self-climbing forms which need not be lifted by a crane.

In order to ensure accurate guidance of the boarding 10 during movement of the form member 4 between its advanced position and the retracted position 4', the climbing forms 1 further comprise elongated horizontal guide means including at least one but preferably at least two parallel guide rails 11 which extend outwardly from the wall 8 and are supported by the platform 5, i.e., not directly by the carriers 7 for the component parts of the platform. The composite form member 4 is reciprocable along such rails to move the boarding 10 between the solid-line position and the broken-line position 10' of FIG. 3. FIG. 3 further shows that at least certain portions of the rails 11 are disposed in the space between the illustrated carriers 7, i.e., it can be said that the rails 11 constitute the longer sides of triangles whose hypotenuses are constituted by the respective carriers 7. This is due to the fact that the inner end portions of the rails 11 are adjacent to the inner end portions of the respective carriers 7 but the carriers 7 extend radially of the wall 8 whereas the rails 11 are parallel to each other. The vertical planes of the rails 11 are parallel to a plane which halves the angle defined by the carriers 7 of FIG. 3.

Figure 2:
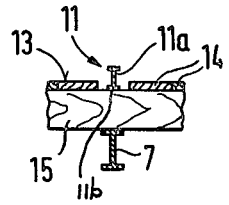
FIG. 2 is a fragmentary vertical sectional view of the platform, substantially as seen in the direction of arrows from the line II—II in FIG. 1, with the railing of the platform omitted.
Figure 4:
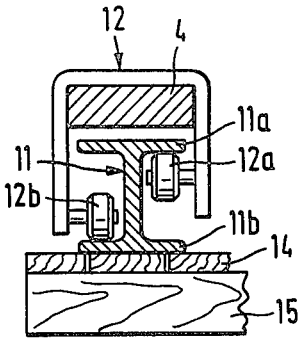
FIG. 4 is a view similar to that of FIG. 2 but showing a portion of a different guide rail which latter is mounted on the floor of the platform.

FIG. 2 shows that the mounting of the rails 11 on the platform 5 and/or on the frame 6 which supports the platform 5 and includes the carriers 7 does not necessitate the provision of uncovered holes or other types of openings in the platform. In other words, an object resting or a person standing on the platform 5 is just as safe when the boarding 10 is adjacent to the wall 8 as when the boarding 10 is moved to the retracted position 10' which is shown in FIG. 3 by broken lines. The form member 4 has followers 12 (preferably at least two for each rail 11) which track and slide along the respective rails 11 to thus ensure reproducible movement of the boarding 10 between the advanced and retracted positions. The followers 12 can be said to form part of or to constitute a carriage or slide which is movable along the rails 11 and is preferably provided with wheels, rollers or analogous rotary elements which roll along the rails during movement of the boarding 10 between the advanced and retracted positions. At least one such roller or wheel can be mounted in such a way that it prevents lifting of the form member 4 off the rails 11. For example, and as shown in FIG. 4, each of the followers 12 can carry a wheel 12*a* which rolls along the underside of the upper flange 11*a* of an I-rail 11 so that the form member 4 cannot be lifted above and away from such rail. Another roller or wheel 12*b* of the follower 12 shown in FIG. 4 rests on and rolls along the upper side of the lower flange 11*b* of the I-rail 11. The I-rail 11 of FIG. 4 can be replaced with a T-rail 111 (see FIG. 5) whereby the roller or wheel 12*a* engages the underside of the flange 111*a* of the rail 111. Another roller or wheel of the follower 112 shown in FIG. 5 can roll along the upper side of the flange 111*a*. FIG. 6 shows a U-rail 211 with a vertical web 211*c* and two horizontal flanges 211*a*, 211*b*. The wheel or roller 212*a* of the follower 212 shown in FIG. 6 engages the underside of the upper flange 211*a*. It is equally possible to employ guide rails in the form of Z-beams or L-beams without departing from the spirit of the invention. All that counts is to ensure that the guide rails have horizontal flanges at their upper ends so that the wheels or rollers 12*a* or 212*a* of the followers 12 or 212 can roll along or can be placed adjacent to the undersides of such flanges in order to prevent unintentional lifting of the form member 4 above and away from the guide rails.

The upper sides or surfaces of the guide rails can be placed at a level below, at the level of or at a level above the upper side or surface of the working platform 5. FIG. 2 shows that the rail 11 which is shown therein rests on and is secured to the horizontal beams 15 which support the boards or planks 14 constituting the floor of the platform 5 and that the neighboring planks 14 define a clearance or gap which is just as wide as, or only slightly wider than, the lower flange 11*b* of the rail 11. This ensures that even a small object which rests on the planks 14 is not likely to fall off the forms 1 while the form member 4 is moved from the advanced to the retracted position or vice versa. The upper flange 11*a* of the rail 11 which is shown in FIG. 2 extends to a level above the upper side or surface 13 of the platform 5. It goes without saying that the guide rails can be mounted directly on the planks 14 (see FIG. 4) so that the aforediscussed clearances can be dispensed with, i.e., the planks 14 can form an uninterrupted floor to even further reduce the likelihood of an object falling off the forms 1 and to further reduce the cost of the forms.

Figure 5:
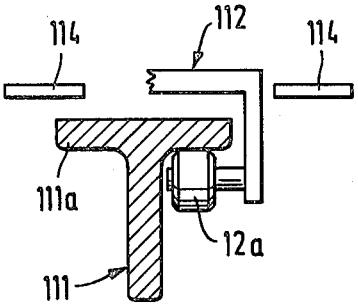
FIG. 5 is a similar view of a portion of a platform and of another guide rail.
Figure 6:
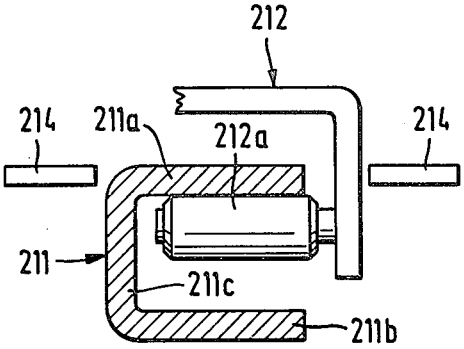
FIG. 6 is a similar view of a platform and of an additional guide rail.

In FIG. 5, the side of the upper flange 111*a* of the guide rail 111 is located at a level below the upper sides of the planks 114. In FIG. 6, the upper side of the upper flange 211*a* of the guide rail 211 is substantially flush with the upper sides of the planks 214.

Figure 7:
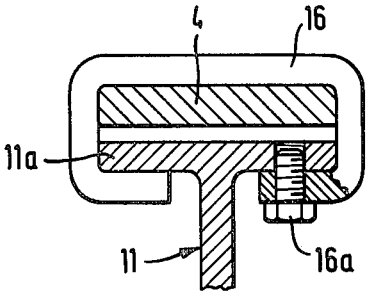
FIG. 7 shows the means for locking the boarding in one of its end positions.

The carriage including the followers 12 on the form member 4 is preferably provided with a clamp 16 which is disposed in the space between the two followers 12 shown in FIG. 1 and is movable along the respective rail 11 between two end positions which are determined by suitable stops, e.g., by adjustably mounted bolts or screws on the corresponding rail 11 or on the platform 5. The clamp 16 can serve the additional purpose or the alternative purpose of facilitating or allowing the locking of boarding 10 in the advanced or retracted position. To this end, the clamp 16 can be provided with one or more bores (note FIG. 7) for bolts or screws 16*a* which are caused to pass through the upper flange 11*a* of the respective rail 11 to releasably but securely hold the form member 4 and the boarding 10 in the advanced or retracted position. The provision of two or more holes or slots in one or both rails 11 (depending upon whether the carriage of the form member 4 has one or two clamps 16) does not weaken the guide rails but renders it possible to releasably lock the parts 10 and 4 in the advanced and/or retracted positions in a very simple, inexpensive and reliable manner.

An important advantage of the invention, which is clearly shown in FIG. 2, is that the platform 5 need not exhibit any openings, slots or analogous voids which could endanger the persons standing on the platform and/or would permit objects or substances (such as tools, bolts, screws, cleaning material or the like) to flow or fall therethrough with attendant danger to the persons or equipment below the platform. This is achieved by the simple expedient of mounting the guide rails on top of the platform or by assembling the planks of the platform in such a way that they provide slots of a width barely sufficing or not much wider than is necessary to accommodate the guide rails.

Another important advantage of the improved climbing forms is that the carriers 7 can extend radially of a convex surface (such as the outer side 2 of the wall 8 shown in FIG. 3) and that such radially extending carriers do not interfere with movement of the boarding 10 and form member 4 (means for moving the boarding) toward and away from the convex outer side 2 of the wall 8. This is achieved by the simple expedient of mounting the carriage of the form member 4 on parallel rails, i.e., by providing for the form member 4 a guide means other than the radially extending divergent carriers 7.

If the guide means for the boarding 10 and form member 4 comprises a single rail, the lower edge portion of the boarding can rest on and can be caused to slide along the upper side of the platform. The single rail then serves primarily as a means for ensuring that the boarding 10 and the form member 4 are confined to reciprocatory movements in desired directions, i.e., between the optimum advanced and the optimum retracted positions of the boarding.

An advantage of one or more rails which are mounted directly on top of the floor including the panels of the platform (note FIG. 4) is that such rails can be installed in existing climbing forms without necessitating substantial alterations of the remaining components.

A further important advantage of the improved climbing forms is that the guide rails can be provided with or can constitute or can cooperate with means for locking the boarding 10 in the advanced and/or in the retracted position. As mentioned above, the locking means can include one or more bolts which are provided on the carriage for the form member and extend through holes or analogous apertures of one or both guide rails. The provision of such holes or apertures in the carriers 7 could weaken the frame for the platform. On the other hand, the making of such holes in one or both guide rails does not weaken the frame which supports the platform because the guide rails are provided in addition to (i.e., they do not constitute component parts of) the frame. Furthermore, and if the locking means were provided on the carriers 7, such locking means would be remote from the locus of application of pronounced stresses so that the climbing forms would have to be provided with additional stiffening means.

It will be noted that the carriers 7 of the frame 4 in the improved climbing forms need not perform the multiple functions of carriers in conventional climbing forms. This is believed to constitute an advantageous feature of the improved climbing forms because the guide means in the form of one or more rails allows for accurate and reliable guidance of the boarding 10 between its advanced and retracted positions without weakening the frame for the platform and without necessitating the provision of uncovered holes, slots, gaps or other types of openings in the floor of the platform. Furthermore, and since the carriers 7 need not guide the boarding 10 and/or the form member 4, such carriers can be provided with reinforcing or stiffening means of any desired design and/or of any desired dimensions since the parts 10 and 4 need not move along the carriers. Still further, the carriers 7 and other parts of the frame 6 which supports the platform can be designed with a view to provide an optimum support for the platform without taking into consideration the movability of the boarding 10 and form member 4. Also, the guide rails can be placed relatively close to one another which is desirable because it ensures more satisfactory balancing of the boarding 10 and form member 4. In other words, the mounting of the guide rails can be selected in such a way that it ensures optimum guidance and ready movability of the boarding 10 between the advanced and retracted positions because the positions of the guide rails are at least substantially independent of the positions, design and number of carriers 7. As can be seen in FIG. 3, the two outermost portions of the boarding 10 extend beyond the respective guide rails 11, as considered in the circumferential direction of the wall 8. This is desirable and advantageous because such outermost portions balance the weight of the parts which are carried by and are disposed between the two guide rails so that the carriages of the form member 4 are less likely to jam during travel along the rails 11. Such mounting of the boarding 10 ensures that the boarding can be moved lengthwise of the guide rails with a minimum of effort because the weight of parts resting on and moving along the two guide rails is fully or adequately balanced. This is so even if the carriages which are movable along the two guide rails are disposed at a considerable distance from each other.

A further important advantage of the improved climbing forms is that the wall or another structure to be erected can be provided with one and the same type of anchors 9 irrespective of whether the outer side of the structure 8 is flat, concave or convex. The same holds true for the female portions of the carriers 7, namely, for those portions which can be suspended on the exposed portions of the anchors 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Climbing forms for use in the erection of structures, such as concrete walls, having arcuate sides, comprising at least one platform; a frame supporting said platform and arranged to be separably supported by the structure which is being erected; a boarding disposed at a level above said platform and having a side at least substantially complementary to the arcuate side of the structure being erected; means for moving said boarding between an advanced position in which said side of the boarding is adjacent to the arcuate side of the structure being erected and a retracted position in which said side of the boarding and the arcuate side of such structure define an arcuate passage accessible to the occupants of the platform; and guide means for said moving means, said moving means being movable with said boarding relative to said guide means and relative to said platform between said advanced and retracted positions.

2. The climbing forms of claim 1, wherein said guide means is provided on said platform.

3. The climbing forms of claim 1 for use in the erection of structures having convex sides, wherein said side of said boarding is concave.

4. The climbing forms of claim 3, wherein said guide means comprises at least one elongated rail.

5. The climbing forms of claim 4, wherein said guide means comprises two spaced-apart rails which are parallel to a line extending substantially radially of said concave side and disposed between said rails.

6. The climbing forms of claim 1, wherein said moving means comprises a carriage which is reciprocable along said guide means.

7. The climbing forms of claim 6, wherein said carriage has at least one rotary element arranged to roll along said guide means.

8. The climbing forms of claim 7, wherein said guide means comprises a rail including an elongated portion having an underside and said rotary element is adjacent to said underside to prevent lifting of the carriage off said rail.

9. The climbing forms of claim 1, wherein said guide means comprises at least one profiled rail.

10. The climbing forms of claim 1, wherein said platform has an upper side and said guide means has an upper side disposed at the general level of the upper side of said platform.

11. The climbing forms of claim 1, wherein said platform has a floor and beams supporting said floor and supported by said frame, said guide means comprising at least one elongated rail mounted on said beams and flanked by said floor.

12. The climbing forms of claim 11, wherein said floor includes planks which are immediately adjacent to said rail.

13. The climbing forms of claim 1, wherein said platform includes a floor and said guide means is mounted on said floor.

14. The climbing forms of claim 1, further comprising means for releasably locking said moving means in at least one of said advanced and retracted positions.

* * * * *